United States Patent [19]

Fricker

[11] 4,383,675

[45] May 17, 1983

[54] QUICK-RELEASE ATTACHMENT FOR CORE BODY IN CONCRETE CASTING FORMWORK

[76] Inventor: Siegfried Fricker, Wurmbergerstrasse 30-34, 7135 Wiernsheim, Fed. Rep. of Germany

[21] Appl. No.: 308,567

[22] Filed: Oct. 5, 1981

[30] Foreign Application Priority Data

Oct. 4, 1980 [DE] Fed. Rep. of Germany ..... 3037595

[51] Int. Cl.[3] ..... B28B 7/04

[52] U.S. Cl. ..... 249/177; 249/180; 249/183; 249/184

[58] Field of Search ..... 249/177, 180, 183, 184

[56] References Cited

U.S. PATENT DOCUMENTS 4,263,249 4/1981 Mayumi ..... 249/183
4,296,909 10/1981 Haeussler ..... 249/178

FOREIGN PATENT DOCUMENTS 866164 4/1961 United Kingdom .
1044473 9/1966 United Kingdom .

*Primary Examiner*—John Parrish
*Attorney, Agent, or Firm*—Joseph A. Geiger

[57] ABSTRACT

A quick-release bayonet-type attachment between a core body and a plank of a concrete casting formwork, the core body being of oblong arcuate outline and holding in a central groove the eye portion of an anchor member, the bayonet-type attachment including a bayonet lock plate embedded in the core body and a cooperating threaded rod with a bayonet lock head. The lock plate and the cooperating head have non-circular cross sections, the lock plate being accessible through an upper bore portion of matching cross section, the bore portion below the lock plate having flexible walls and a rotationally offset non-circular cross section.

6 Claims, 5 Drawing Figures

QUICK-RELEASE ATTACHMENT FOR CORE BODY IN CONCRETE CASTING FORMWORK

BACKGROUND OF THE INVENTION

1. Field of the Invention

The present invention relates to concrete casting equipment and accessories and, more particularly, to a composite core body for the positioning of an anchor element in a prefabricated concrete member in such a way that an exposed end portion of the anchor element is positioned within an arcuate recess of the concrete member.

2. Description of the Prior Art

It is known to utilize recessed "lost anchors" for the handling of heavy prefabricated concrete members. The recessed arrangement of the anchor elements has the advantage of eliminating the need for a cutting operation on the anchor element, after the concrete member has been hoisted to its intended place in the building structure.

A hoisting attachment which features such a recessed anchor element is disclosed in U.S. Pat. No. 3,883,170. The hoisting harness includes a torus-shaped clasp-like hoisting shackle with a transverse slot and an arcuate locking bolt reaching across the slot and cooperating with an exposed eye portion of the anchor member engaged in the slot. The result is a secure connection which can be released by retracting the arcuate locking bolt of the shackle behind its transverse slot.

This hoisting attachment features on oblong arcuate recess in the concrete member to enable the torus-shaped hoisting shackle to reach over and engage the anchor element whose eye portion is arranged in the center of the recess. The casting of such a recess and the positioning of the anchor element are accomplished with the aid of a special core body which has the shape of a flattened spheroid which has been cut in half transversely. This core body encloses and holds the later exposed eye portion of the anchor element while being attached to the inside of a side plank of the formwork.

It has been found that, in order to safely attach the anchor element in a cantilever-type connection with the core body, the flanks of the core body engaging the eye portion of the anchor element must also engage the eye opening itself. This presents a problem in connection with the removal of the core body from the finished concrete member in that the release of the core body from the anchor element necessitates an opening movement on the part of these anchor positioning flanks. This problem is solved by arranging the anchor positioning flanks in the core body as opposite sides of a transverse groove which reduces the mid-portion of the core body to a thin bridge portion. This bridge portion forms a flexible hinge between two quarter-sectors of the "flattened spheroid", for the required opening displacement of the anchor positioning flanks.

The prior art further suggests the use of a threaded rod for the attachment of the described core body to the formwork. In order to connect the threaded rod to the core body, the latter includes an embedded internally threaded member, such as a threaded nut, for example, which is accessible through a bore. The core body is attached to the formwork by first threading one end portion of the threaded rod into the threaded member of the core body and by then screwing a wing nut from the opposite direction against the outside of the formwork, thereby clamping the core body against the formwork plank.

It has been found that the internal thread of the nut or threaded member is subject to assembly problems, due to the accumulation of particles in the bore or bores of the core body and that excessive friction in this threaded connection may impede, or even prevent, the attachment operation.

SUMMARY OF THE INVENTION

Underlying the present invention is the primary objective of eliminating the aforementioned shortcomings of the prior art core body by suggesting an improved core body attachment which, while keeping the production costs to a minimum, is much less subject to assembly problems in the presence of dirt particles and which, by eliminating a threading operation, greatly shortens the time required for the attachment of the core body to the formwork.

The present invention proposes to attain these objectives by suggesting a core body which has embedded in it a plate with a non-circular opening which serves as a bayonet lock plate, the plate cooperating with a threaded rod whose extremity is formed into a bayonet lock head which is insertable through the plate opening.

In a preferred embodiment of the invention, the bayonet lock plate is arranged at a certain depth inside the core body, below a guide bore portion. The latter, having the same opening contour as the lock plate, conveniently guides the bayonet lock head of the threaded rod into the lock plate. A second bore portion beyond the bayonet lock plate makes it possible for the bayonet lock head to be inserted beyond the plate and to be locked thereagainst by a quarter-turn rotation of the threaded rod.

The bayonet lock plate may have appropriate notches to provide a seat for the bayonet lock head in the locked position, or this seating action may be provided by the second bore portion behind the bayonet lock plate by means of a bore cross section shaped to correspond to the profile of a 90°-rotated bayonet lock head, provided the material forming said bore is appropriately compressible.

In a different embodiment of the invention, the core body has arranged on its attachment side a mounting channel which simultaneously serves as a bayonet lock plate, having one or two non-circular bayonet-type openings. This version does not have a guide bore portion.

The bayonet lock head at the extremity of the threaded rod is preferably produced in a simple swaging action in which the extremity of the threaded rod is flattened in one transverse direction and consequently expanded in the perpendicular transverse direction, to form opposite retaining shoulders.

Because it has been found that, in most cases, the use of only one threaded rod is sufficient for the attachment of a core body holding an anchor element, the present invention further suggests a core body configuration in which the latter has embedded in it not only a bayonet lock plate as suggested by the invention, but also a second attachment insert in the form of the earlier-described known threaded member, in order to provide the additional possibility of using a plain threaded rod, in the event that a threaded rod with a bayonet lock head is not available.

BRIEF DESCRIPTION OF THE DRAWINGS

Further special features and advantages of the invention will become apparent from the description following below, when taken together with the accompanying drawings which illustrate, by way of example, an embodiment of the invention represented in the various figures as follows.

DESCRIPTION OF THE PREFERRED EMBODIMENTS

Figure 1:
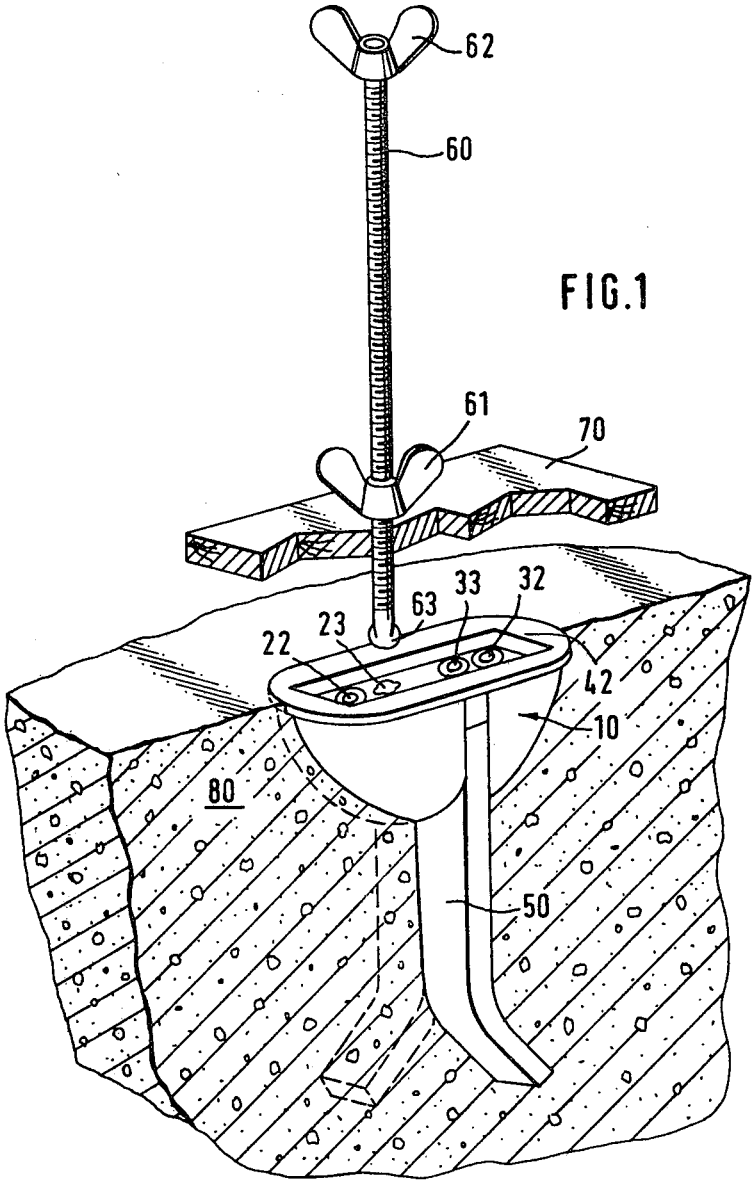
FIG. 1 shows, in a partially sectioned perspective view, a core body in accordance with the present invention, the core body being shown just prior to its removal from a finished concrete member.

Referring to FIG. 1 of the drawing, it can be seen that the core body assembly 10 is positioned flush with the face of a prefabricated concrete member 80, as a result of its attachment to the inner side of a formwork plank 70 which is just being removed. Serving to attach the core body assembly 10 to the plank 70 is a threaded rod 60 and a cooperating wing nut 61. A second wing nut 62 is welded to the extremity of the threaded rod 60 to serve as a rotation handle. The threaded rod 60 has at its lower end a bayonet lock head 63 with which it is attachable to a cooperating attachment insert inside the core body assembly, as will be described in more detail further below.

Figure 2:
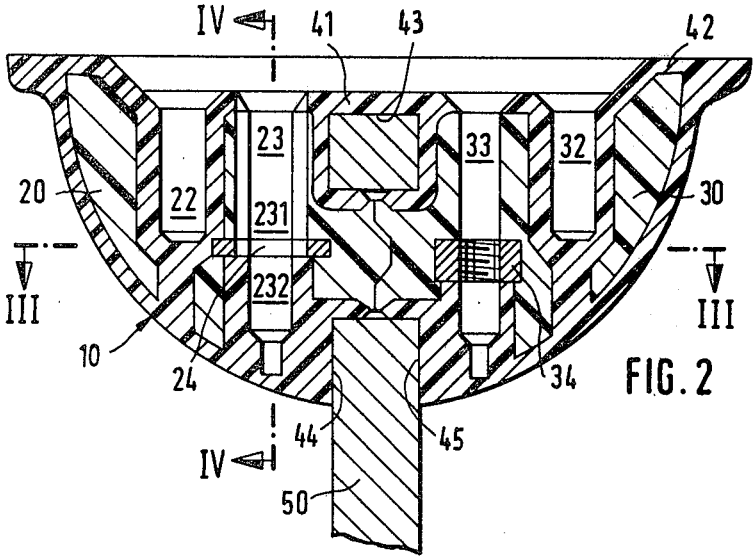
FIG. 2 shows the core body of FIG. 1 and the eye portion of an attached anchor element in an enlarged longitudinal cross section, as taken along line II—II of FIG. 3.
Figure 3:
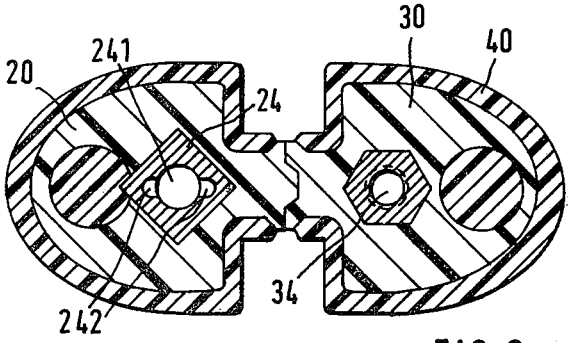
FIG. 3 shows a cross section through the core body of FIG. 2, taken along line III—III of the latter.

As can be seen in FIGS. 2 and 3, the core body assembly consists essentially of two sector-shaped inner core body parts 20 and 30 which are enclosed within a core body jacket 40. The shape of the latter, resembling a transversely cut flattened spheroid, determines the shape of the recess which is to be produced in the concrete member 80.

The two inner core body parts 20 and 30 are spaced a distance from the center plane of the core body assembly so as to form a transverse anchor retaining groove with parallel oppositely oriented anchor positioning flanks 44 and 45. The outer side of a central connecting bridge 41 of the core body jacket 40 forms the bottom face 43 of the anchor retaining groove.

In order to reliably position the anchor element 50 in the core body assembly 10, the latter further includes centering protrusions 21 and 31 which extend into the anchor retaining groove so as to engage the eye aperture 51 of the anchor element 50. The two centering protrusions 21 and 31 abut against each other half-way between the anchor positioning flanks 44 and 45, one of the abutting protrusions having a tapered button 211 and the other having a matchingly tapered depression 311, so that the two protrusions 21 and 31 are forcibly aligned, when pressed against each other. The anchor positioning flanks 44 and 45 as well as the centering protrusions 21 and 31 are lined with wall portions of the core body jacket 40, so that only the latter touches the anchor element.

The connecting bridge 41 on the inner side of the core body assembly 10 constitutes the only connection between the two sectors of the core body assembly. It follows that, since this connecting bridge is part of the flexible core body jacket, it can serve as a bending hinge around which the two sectors of the assembly are pivotable, thereby making it possible to separate the anchor positioning flanks 44 and 45. Such a separating movement is necessary, when the eye portion of the anchor element 50 is to be inserted into the anchor retaining groove of the core body assembly, and it is again necessary, when the core body assembly is to be removed from the set concrete.

In order to facilitate the bending action on the core body assembly, especially in connection with its release from the permenently embedded anchor element, the core body assembly has arranged in it two blind bores 22 and 32. By inserting suitable rods into these two bores and by tilting the rods against each other, the two sectors of the core body assembly can be effortlessly separated to open up the anchor retaining groove.

Both the inner core body parts 20 and 30 and the core body jacket 40 are produced and assembled in injection molding operations, the core body jacket being cast around the two inner parts. It has been found that polyamide is a suitably rigid material for the inner core body parts 20 and 30, while polyurethane or a soft PVC will provide the necessary flexibility for the core body jacket.

As stated earlier, the invention suggests the use of a threaded rod 60 (FIG. 1) for the attachment of the core body to the plank 70 of the formwork. For this purpose, the core body has arranged in at least one of its inner core body parts a permanently embedded bayonet lock plate 24 which is visible in FIGS. 2, 3 and 4. The bayonet lock plate 24 is a steel washer of square outline, having a central bore 241 and two diametrically oppositely arranged notch-like axial grooves 242. Cooperating with the lock plate 24 is a bayonet lock head 63 on the extremity of the threaded rod 60.

Figure 4:
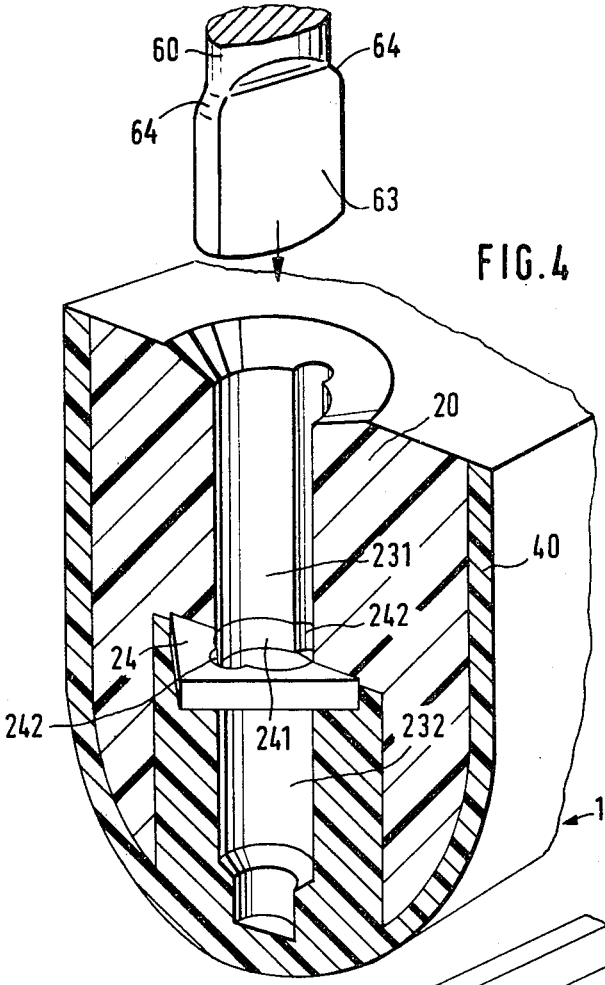
FIG. 4 shows, in a perspective view, a further enlarged transverse cross section through the core body of FIG. 2, taken along line IV—IV of the latter.

As can be seen in FIG. 4, the lock head 63 is a flattened end portion of the threaded rod 60, obtained in a swaging operation, for example. The width of the lock head 63 is larger than the diameter of the bore 241 of the lock plate 24, but small enough to pass through the lock plate 4, when aligned with its axial grooves 242. Thus, it is possible to insert the bayonet lock head 63 of the threaded rod 60 through the bayonet lock plate 24 and to create a locking action by rotating the threaded rod 60 approximately one-quarter turn.

As can be seen in FIGS. 2 and 4, the bayonet lock plate 24 is arranged at a certain depth inside the core body and supported by the material of the rigid inner core body part 20, for example. The bore 23 which leads to the bayonet lock plate 24 has a first bore portion 231 above the bayonet plate 24 and a second bore portion 232 underneath it. The upper bore portion 231 has a cross section which corresponds substantially to that of the lock plate 24, thus serving as a guide bore for the lock head 63 of the threaded rod 60.

Unlike the first bore portion 231, which is formed by the rigid body part 20, the lower bore portion 232 is formed by a portion of the softer core body jacket 40. This bore portion, therefore, need not have the exact non-circular cross section of the bayonet lock plate 24, for the lock head 63 to be able to penetrate below the lock plate 24. In FIGS. 2 and 4, the lower bore portion is shown to be cylindrical, so that the shoulders 64 of the lock head 63 deform the material surrounding the bore portion 232 during their penetration and in their 90°-rotated locked position. This deformation entails a certain resistance against the insertion movement of the threaded rod 60, as well as against its rotation into and out of the 90°-rotated position. It thus presents a safety against accidental release of the bayonet lock during the clamping operation, when the core body is pulled against the plank 70 by means of the wing nut 61.

Figure 5:
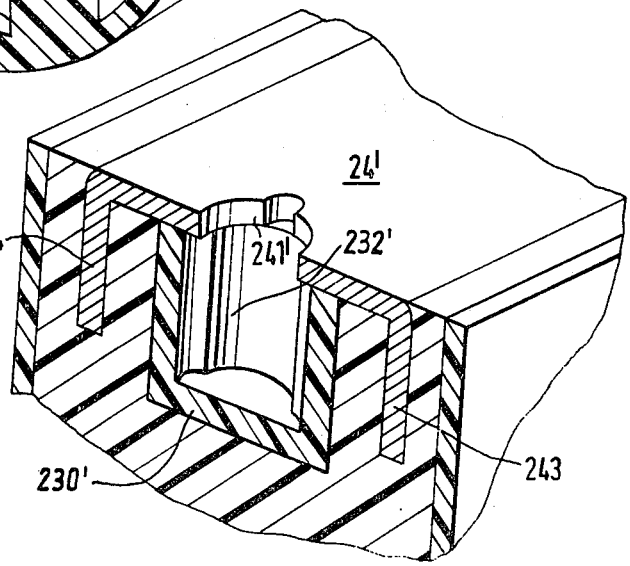
FIG. 5 shows, likewise in a perspective view, a cross section comparable to that of FIG. 4, representing a modified embodyment of the invention.

FIG. 5 shows a modified embodiment of the present invention in which the imbedded bayonet lock plate 24 has been replaced by a face plate 24' in the form of a channel shape. The latter has its backside arranged in alignment with the inner face of the core body and its two flange portions 243 and 244 penetrated into one of the inner core body parts. The face plate 24' thus may remain attached to the formwork for repeated concrete casting operations.

FIG. 5 shows that the face plate 24' has a non-circular opening 241' which corresponds in shape to the opening of the earlier-described bayonet lock plate 24 (FIG. 4). While this embodiment does not have a lead-in bore, like the upper bore portion 231 of FIG. 4, it has a lower bore portion 232' formed in a plug 230' of soft material. This lower bore portion 232' has a non-circular cross section which is similar to that of the bore 241' of the face plate 24'. However, its axial grooves are arranged at a 90° rotational offset, i.e. in alignment with the 90°-rotated locking position of the bayonet lock head 63. Thus, the yielding wall material of the lower bore portion 232' serves as a rotational detent to retain the bayonet lock head 63 in its locked position. It should be understood that the same feature may also be incorporated in the lower bore portion 232 of the earlier-described embodiment of FIGS. 2–4.

While FIGS. 1–4 show a core body which incorporates two different attachment inserts, viz. the described bayonet lock plate 24, adapted to cooperate with the bayonet lock head 63 of the threaded rod 60 and a conventional threaded nut 34 adapted to cooperate with a bolt or a length of threaded rod, it should be understood that this is not a requirement for the practice of the present invention. Nor is it absolutely necessary for the core body to be composed of two rigid inner core body parts and a flexible outer core body jacket, in order to arrange in the core body a bayonet-type connection as described above. The special advantages of a composite core body assembly are described in more detail in my copending U.S. patent application, Ser. No. 308,566, filed Oct. 5, 1981.

It should be understood, of course, that the foregoing disclosure describes only preferred embodiments of the invention and that it is intended to cover all changes and modifications of these examples of the invention which fall within the scope of the appended claims.

I claim the following:

1. A core body for the creation of an oblong arcuate recess in a face of a prefabricated concrete member and for the simultaneous positioning of an embedded anchor element in such a way that an eye portion of the element is located in the center of said recess and below said face, the core body comprising:

a core body of a shape which represents the spatial negative of the desired recess, the core body having an attachment face for clamping contact with a formwork surface;

a central opening in the core body for the engagement therein of the eye portion of the anchor element in such a way that the core body carries the anchor element; and means for releasably attaching the core body to the formwork surface; and wherein the attaching means includes, as part of the core body, a bayonet lock plate with a non-circular bore, and an elongated fastener member having on one extremity thereof an enlarged bayonet lock head of a cross section which matches the non-circular bore of the lock plate so that the lock head of the fastener member is insertable through the lock plate, when aligned therewith, but is not retractable when rotated out of alignment, following insertion, thus creating a releasable bayonet-type connection.

2. A core body as defined in claim 1, wherein at least major portions of the core body are of a non-metallic, comparatively weak material;

the bayonet lock plate is a metal plate which is embedded in the non-metallic material of the core body at a certain depth from and parallel to its attachment face;

the core body has an insertion bore which is oriented perpendicularly to the attachment face and aligned with the non-circular bore of the lock plate.

3. A core body as defined in claim 2, wherein the insertion bore of the core body has a first portion thereof arranged ahead of the bayonet lock plate, said first bore portion having substantially the same non-circular cross section as the lock plate; and said first bore portion has its cross section aligned with the bore of the lock plate, so as to serve as a guide bore for the insertion of the bayonet lock head.

4. A core body as defined in any one of claims 1 through 3, wherein the core body, having an insertion bore in alignment with the non-circular bore of the bayonet lock plate, has a second portion thereof arranged behind the lock plate; and said second bore portion is surrounded by compressible material of the core body and so arranged in relation to the bore of the lock plate that the insertion of the bayonet lock head causes a deformation of the wall of the bore portion, thereby creating a frictional retaining action on the inserted lock head.

5. A core body as defined in claim 4, wherein said second bore portion behind the bayonet lock plate has a cross section which is similar to the shape of the bore of the bayonet lock plate, but angularly offset in relation thereto, so that a rotational detent action is created on the inserted lock head.

6. A core body as defined in claim 4, wherein the non-circular shape of the bore of the bayonet lock plate is constituted by a circle and two diametrically oppositely located radial recesses defining axial grooves in the bore; and the cooperating bayonet lock head of the fastener member has a shape as obtained by flattening the end portion of a cylindrical rod from opposite sides, resulting in a rectangular cross section with two radially protruding shoulders.

* * * * *